US008403036B2

(12) United States Patent
Neer et al.

(10) Patent No.: US 8,403,036 B2
(45) Date of Patent: Mar. 26, 2013

(54) SINGLE PIECE PACKER EXTRUSION LIMITER RING

(75) Inventors: Adam K. Neer, Marlow, OK (US); Emil Havelka, Houston, TX (US); Lloyd Crockford, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 372 days.

(21) Appl. No.: 12/881,985

(22) Filed: Sep. 14, 2010

(65) Prior Publication Data

US 2012/0061105 A1 Mar. 15, 2012

(51) Int. Cl.
*E21B 33/128* (2006.01)
*E21B 33/129* (2006.01)

(52) U.S. Cl. ..... 166/134; 166/118; 166/196; 277/338; 277/339; 277/340; 277/341

(58) Field of Classification Search ..... 166/118, 166/134, 196; 277/337–341
See application file for complete search history.

(56) References Cited

U.S. PATENT DOCUMENTS

| | | | |
|---|---|---|---|
| 2,368,428 | A | 1/1945 | Saurenman |
| 3,154,145 | A | 10/1964 | Brown |
| 3,239,008 | A | 3/1966 | Leutwyler |
| 3,951,211 | A | 4/1976 | Ellis |
| 4,285,458 | A | 8/1981 | Slavens |
| 4,288,082 | A | 9/1981 | Setterberg, Jr. |
| 4,516,634 | A | 5/1985 | Pitts |
| 4,682,724 | A | 7/1987 | Hahn |
| 4,708,202 | A | 11/1987 | Sukup et al. |
| 4,745,972 | A | 5/1988 | Bell et al. |
| 4,753,444 | A | 6/1988 | Jackson et al. |
| 4,756,364 | A | 7/1988 | Christensen et al. |
| 4,794,989 | A | 1/1989 | Mills |
| 4,968,184 | A | 11/1990 | Reid |
| 5,044,434 | A | 9/1991 | Burns, Sr. et al. |
| 5,103,904 | A | 4/1992 | Luke et al. |
| 5,224,540 | A | 7/1993 | Streich et al. |
| 5,271,468 | A | 12/1993 | Streich et al. |
| 5,311,938 | A | 5/1994 | Hendrickson et al. |
| 5,343,954 | A | 9/1994 | Bohlen et al. |
| 5,390,737 | A | 2/1995 | Jacobi et al. |
| 5,404,956 | A | 4/1995 | Bohlen et al. |
| 5,433,269 | A | 7/1995 | Hendrickson |
| 5,540,279 | A | 7/1996 | Branch et al. |
| 5,603,511 | A | 2/1997 | Keyser, Jr. et al. |
| 5,676,384 | A | 10/1997 | Culpepper |
| 5,701,954 | A | 12/1997 | Kilgore et al. |
| 5,701,959 | A | 12/1997 | Hushbeck et al. |
| 5,720,343 | A | 2/1998 | Kilgore et al. |
| 5,857,520 | A | 1/1999 | Mullen et al. |
| 5,904,354 | A | 5/1999 | Collins |
| 5,944,102 | A | 8/1999 | Kilgore et al. |
| 6,102,117 | A | 8/2000 | Swor et al. |
| 6,112,811 | A | 9/2000 | Kilgore et al. |

(Continued)

*Primary Examiner* — Giovanna Wright
(74) *Attorney, Agent, or Firm* — John W. Wustenberg; Conley Rose, P.C.

(57) ABSTRACT

An apparatus for use in a wellbore is provided. The apparatus comprises a mandrel, a sealing element carried on the mandrel, the sealing element being radially expandable from a first run-in diameter to a second set diameter in response to application of axial force on the sealing element, and an extrusion limiting assembly carried on the mandrel and proximate the sealing element. The extrusion limiting assembly comprises a plurality of separate segments and a first circumferential band that retains the plurality of segments in a ring shape and substantially covers an outer circumferential surface of the plurality of segments while in a run-in condition of the apparatus.

19 Claims, 14 Drawing Sheets

U.S. PATENT DOCUMENTS

| | | | | |
|---|---|---|---|---|
| 6,220,349 | B1 | 4/2001 | Vargus et al. | |
| 6,302,217 | B1 | 10/2001 | Kilgore et al. | |
| 6,318,460 | B1 | 11/2001 | Swor et al. | |
| 6,394,180 | B1 | 5/2002 | Berscheidt et al. | |
| 6,491,116 | B2 | 12/2002 | Berscheidt et al. | |
| 6,598,672 | B2 | 7/2003 | Bell et al. | |
| 6,695,050 | B2 | 2/2004 | Winslow et al. | |
| 6,695,051 | B2 | 2/2004 | Smith et al. | |
| 6,793,022 | B2 | 9/2004 | Vick et al. | |
| 6,827,150 | B2 | 12/2004 | Luke | |
| 7,210,533 | B2 | 5/2007 | Starr et al. | |
| 7,328,750 | B2 | 2/2008 | Swor et al. | |
| 7,373,973 | B2 | 5/2008 | Smith et al. | |
| 7,708,080 | B2 | 5/2010 | Conaway et al. | |
| 8,167,033 | B2 * | 5/2012 | White | 166/196 |
| 2006/0232019 | A1 | 10/2006 | Garrison et al. | |

* cited by examiner

SINGLE PIECE PACKER EXTRUSION LIMITER RING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in a well. Downhole tools referred to as packers and bridge plugs are designed for these general purposes and are well known in the art of producing oil and gas.

When it is desired to remove many of these downhole tools from a wellbore, it is frequently simpler and less expensive to mill or drill them out rather than to implement a complex retrieving operation. In milling, a milling cutter is used to grind the packer or plug, for example, or at least the outer components thereof, out of the wellbore. In drilling, a drill bit is used to cut and grind up the components of the downhole tool to remove it from the wellbore. This is a much faster operation than milling, but requires the tool to be made out of materials which can be accommodated by the drill bit. To facilitate removal of packer type tools by milling or drilling, packers and bridge plugs have been made, to the extent practical, of non-metallic materials such as engineering grade plastics and composites.

Non-metallic backup shoes have been used in such tools to support the ends of packer elements as they are expanded into contact with a borehole wall. The shoes are typically segmented and, when the tool is set in a well, spaces between the expanded segments have been found to allow undesirable extrusion of the packer elements, at least in high pressure and high temperature wells. This tendency to extrude effectively sets the pressure and temperature limits for any given tool. Numerous improvements have been made in efforts to prevent the extrusion of the packer elements, and while some have been effective to some extent, they have been complicated and expensive.

SUMMARY OF THE INVENTION

In an embodiment, an apparatus for use in a wellbore is disclosed. The apparatus comprises a mandrel, a sealing element carried on the mandrel, the sealing element being radially expandable from a first run-in diameter to a second set diameter in response to application of axial force on the sealing element, and an extrusion limiting assembly carried on the mandrel and proximate the sealing element. The extrusion limiting assembly comprises a plurality of separate segments and a first circumferential band that retains the plurality of segments in a ring shape and substantially covers an outer circumferential surface of the plurality of segments while in a run-in condition of the apparatus. In an embodiment, the first band is expandable and expands with deployment of the plurality of segments while in a set condition of the sealing element. In an embodiment, the first band comprises an elastomer. In an embodiment, the first band comprises one of silicone, Nitrile, hydrogenated nitrile butadiene rubber (HNBR), fluoroelastomer, silicon rubber, and nitrile rubber. In an embodiment, the outer circumferential surface of the plurality of segments in a run-in condition of the apparatus define a circumferential groove, and the extrusion limiting assembly further comprises a second circumferential band that is disposed in the groove inside of the first band, wherein the second band breaks during expansion of the segments in response to the application of axial force. In an embodiment, the first band breaks with deployment of the plurality of segments during activation of the sealing element. In an embodiment, the segments are non-metallic.

In an embodiment, a method of servicing a wellbore is disclosed. The method comprises running in the downhole tool into the wellbore, wherein the downhole tool has a sealing element carried on a mandrel and an extrusion limiting assembly comprising a plurality of separate segments and a first circumferential band that substantially covers an outer circumferential surface of the segments in a run-in condition. The method further comprises setting the downhole tool, wherein during setting the sealing element engages one of the wellbore wall or a casing wall and wherein during setting the extrusion limiting assembly maintains a substantially continuous face proximate the sealing element and treating the wellbore. In an embodiment, the downhole tool is one of a packer or a plug. In an embodiment, the method further comprises removing the packer or the plug from the wellbore. In an embodiment, removing the packer or plug comprises drilling out the packer or the plug. In an embodiment, the method further comprises the extrusion limiting assembly mitigating extrusion of the sealing element. In an embodiment, the first circumferential band mitigates extrusion of the sealing element through gaps between the segments. In an embodiment, the extrusion limiting assembly further comprises a second circumferential band covered by the first circumferential band, and the method further comprises the first circumferential band confining the second circumferential band when the second circumferential band breaks during setting of the downhole tool.

In an embodiment, a downhole tool is disclosed. The downhole tool comprises a mandrel, a packing element carried on the mandrel, and an extrusion limiting assembly carried on the mandrel and proximate the packing element. The extrusion limiting assembly comprises a plurality of separate segments and an elastomeric cover that is one of molded circumferentially over or coated circumferentially over the segments. In an embodiment, the elastomeric cover mitigates extrusion of the packing element through gaps between the segments in a set condition of the downhole tool. In an embodiment, the elastomeric cover is from about 0.010 inches thick to about 0.090 inches thick. In an embodiment, the segments are comprised of at least one of epoxy material, phenolic material, and other thermoset material. In an embodiment, the segments number inclusively from four segments to sixteen segments. In an embodiment, the cover is one of silicone, Nitrile, HNBR, fluoroelastomer, silicon rubber, nitrile rubber, or other material. In an embodiment, the downhole tool further comprises an end component carried on the mandrel at a downhole end of the tool, wherein the end component is comprised of a drillable material and defines a first notch in a downhole edge of the end component, wherein the width of the first notch is at least ten percent and less than forty percent of the circumference of the downhole edge and the depth of the first notch is at least ten percent of the length of the end component.

In an embodiment, a downhole tool is disclosed. The downhole tool comprises a mandrel, a packing element carried on the mandrel, and an end component carried on the mandrel at a downhole end of the tool. The end component is comprised of a drillable material and defines a first notch in a downhole edge of the end component, wherein the width of the first notch is at least ten percent and less than forty percent of the circumference of the downhole edge and the depth of the first notch is at least ten percent of the length of the end component. In an embodiment, the end component further defines a second notch in the downhole edge of the end component, wherein a center of the second notch is about 180 degrees circumferentially away from a center of the first notch. In an embodiment, the end component defines a cylindrical shell and the mandrel extends partially into an uphole end of the end component, and the end component further comprises a pin held by two holes in a wall of a downhole end of the end component without passing through the mandrel. In an embodiment, the end component defines a cylindrical shell, an uphole end of the cylindrical shell has a first outside diameter, and a downhole end of the cylindrical shell has a second outside diameter, wherein the first outside diameter is greater than the second outside diameter. In an embodiment, the uphole end of the cylindrical shell has a first inside diameter and the downhole end of the cylindrical shell has a second inside diameter, wherein the first inside diameter is less than the second inside diameter. In an embodiment, the outer circumferential side of the cylindrical downhole edge is beveled. In an embodiment, the end component further comprises a ceramic insert coupled to an inside of a downhole end of the end component. In an embodiment, the downhole tool further comprises an extrusion limiting assembly carried on the mandrel and proximate the packing element, wherein the extrusion limiting assembly comprises a plurality of separate segments and an elastomeric band that substantially covers an outer circumferential surface of the separate segments.

These and other features will be more clearly understood from the following detailed description taken in conjunction with the accompanying drawings and claims.

DETAILED DESCRIPTION OF THE PREFERRED EMBODIMENTS

It is known that wellbores may be drilled any of vertically, deviated, and/or horizontally. In the following description, reference to up or down will be made for purposes of description with "up," "upper," "upward," "upstream," or "uphole" meaning toward the surface of the wellbore and with "down," "lower," "downward," "downstream," or "downhole" meaning toward the terminal end of the well, regardless of the wellbore orientation.

Figure 1:
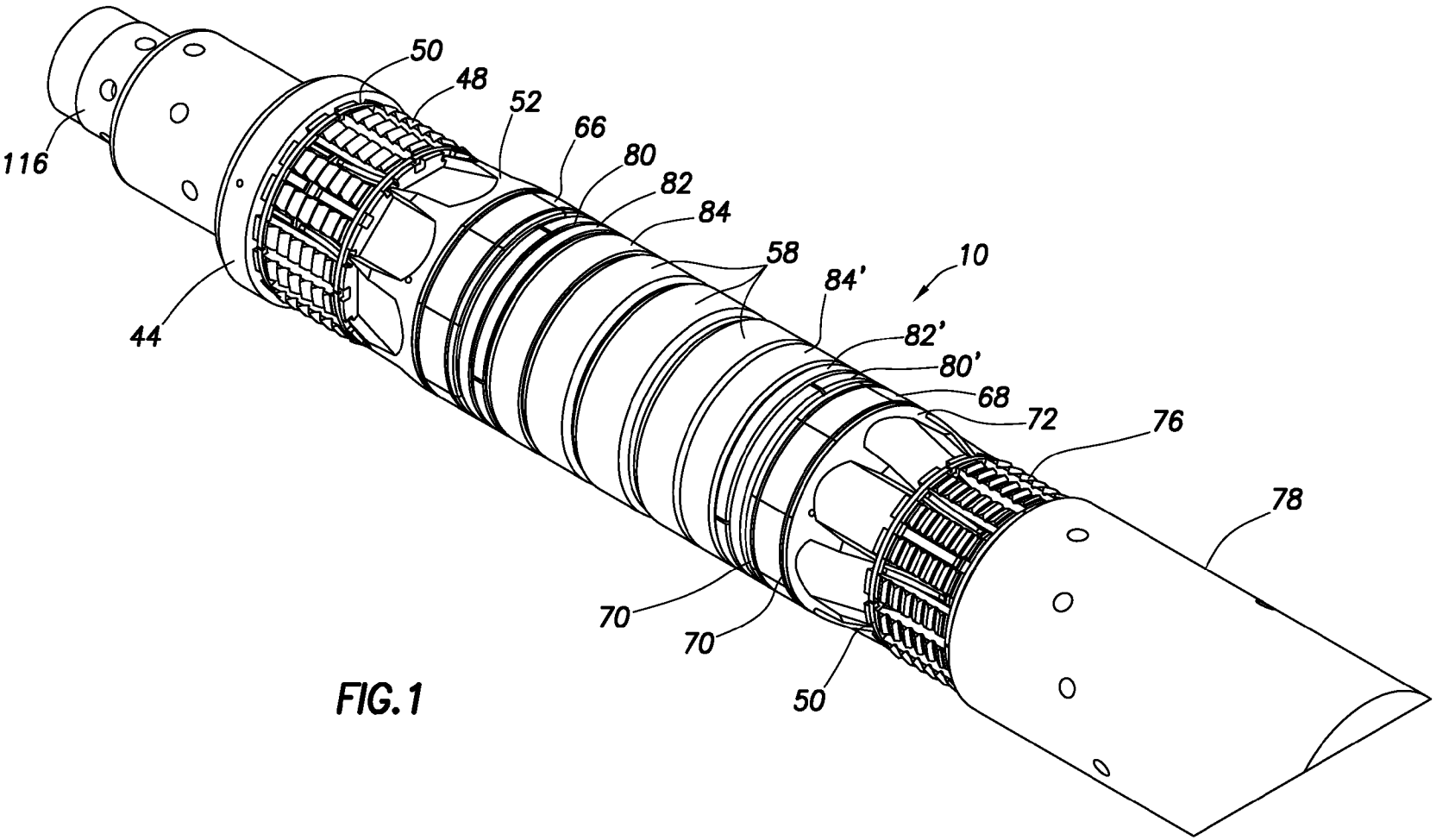
FIG. 1 is a perspective view of a bridge plug tool in its run in condition according to an embodiment.
Figure 2A:
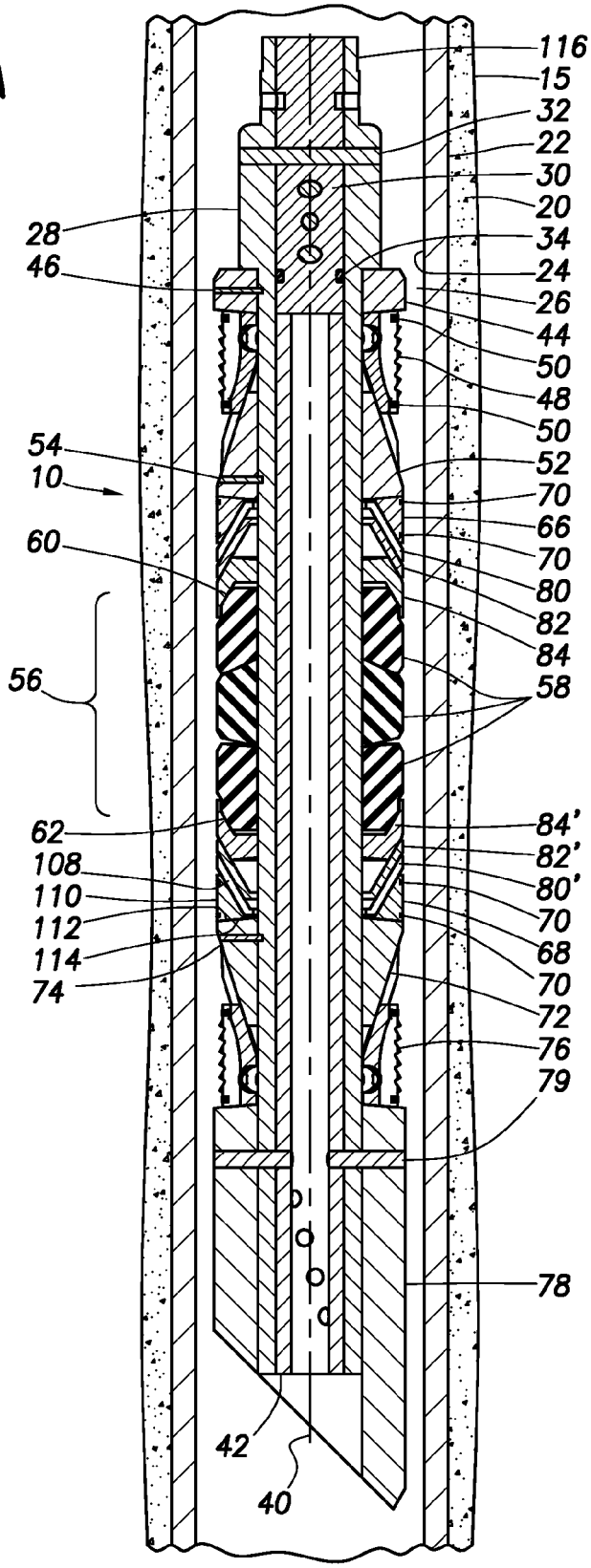
FIG. 2A is a cross sectional view of the bridge plug tool of FIG. 1 in its run in condition.
Figure 2B:
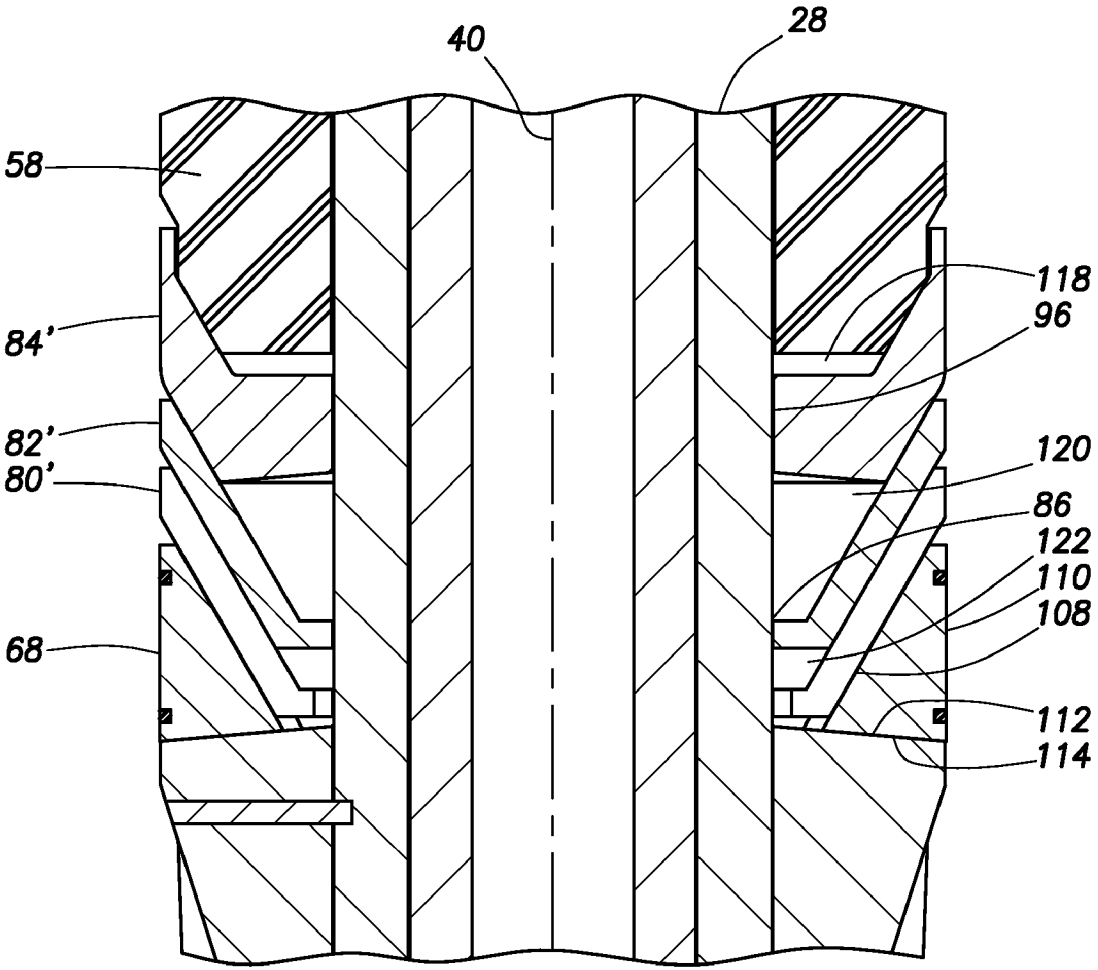
FIG. 2B is a cross sectional view of a portion of the bridge plug tool of FIG. 1 in its run in condition showing details of extrusion limiters.

FIG. 1 is a perspective view of a bridge plug embodiment 10 in an unset or run in condition. In FIGS. 2A and 2B, the bridge plug 10 is shown in the unset condition in a well 15. The well 15 may be either a cased completion with a casing 22 cemented therein by cement 20 as shown in FIG. 2A or an openhole completion. Bridge plug 10 is shown in set position in FIGS. 3A and 3B. Casing 22 has an inner surface 24. An annulus 26 is defined between casing 22 and downhole tool 10. Downhole tool 10 has a packer mandrel 28, and is referred to as a bridge plug due to a plug 30 being pinned within packer mandrel 28 by radially oriented pins 32. Plug 30 has a seal means 34 located between plug 30 and the internal diameter of packer mandrel 28 to prevent fluid flow therebetween. The overall downhole tool 10 structure, however, is adaptable to tools referred to as packers, which typically have at least one means for allowing fluid communication through the tool. Packers may therefore allow for the controlling of fluid passage through the tool by way of one or more valve mechanisms (e.g., a one way check valve) which may be integral to the packer body or which may be externally attached to the packer body. Packer tools may be deployed in wellbores having casings or other such annular structure or geometry in which the tool may be set.

Packer mandrel 28 has a longitudinal central axis, or axial centerline 40. An inner tube 42 is disposed in, and is pinned to, packer mandrel 28 to help support plug 30.

Tool 10 includes a spacer ring 44 which is preferably secured to packer mandrel 28 by shear pins 46. Spacer ring 44 provides an abutment which serves to axially retain slip segments 48 which are positioned circumferentially about packer mandrel 28. Slip retaining bands 50 serve to radially retain slip segments 48 in an initial circumferential position about packer mandrel 28 and slip wedge 52. Bands 50 may be made of a steel wire, a plastic material, or a composite material having the requisite characteristics of having sufficient strength to hold the slip segments 48 in place prior to actually setting the tool 10 and to be easily drillable and/or millable when the tool 10 is to be removed from the wellbore 15.

Preferably, bands 50 are inexpensive and easily installed about slip segments 48. Slip wedge 52 is initially positioned in a slidable relationship to, and partially underneath, slip segments 48 as shown in FIGS. 1 and 2A. Slip wedge 52 is shown pinned into place by shear pins 54.

Figure 3A:
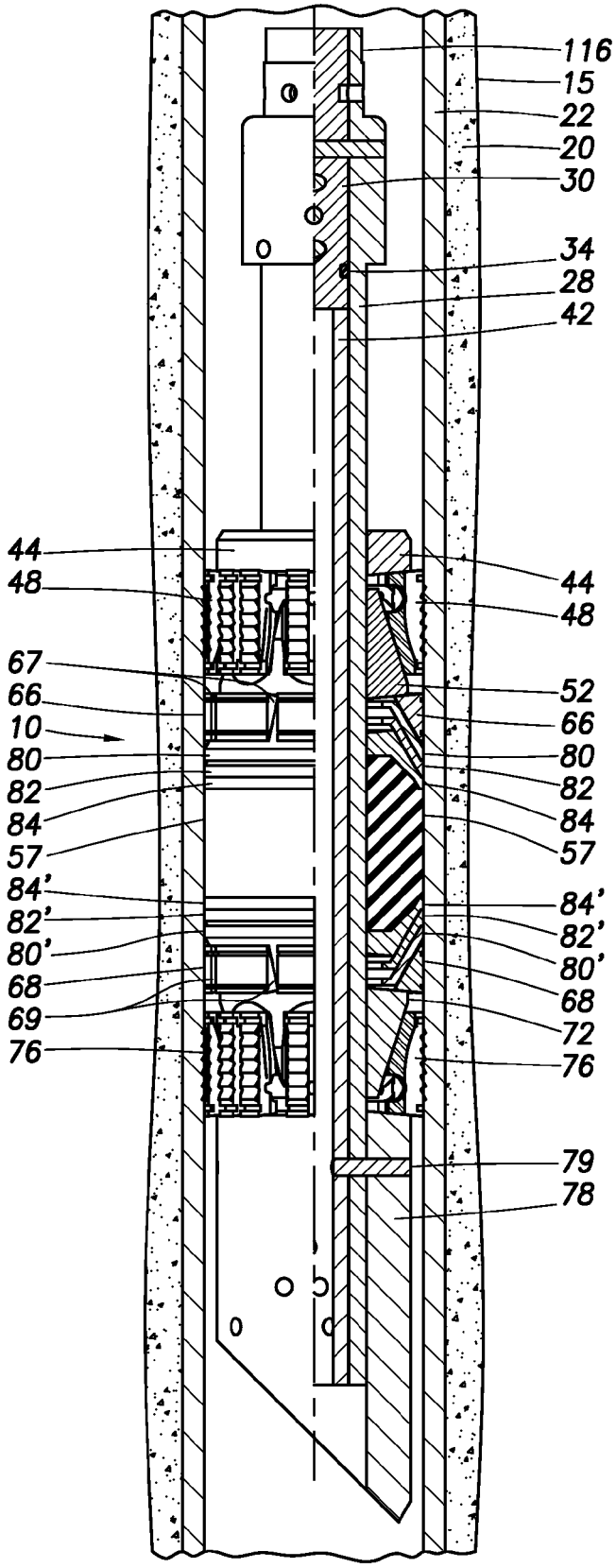
FIG. 3A is an illustration of the bridge plug tool of FIGS. 1, 2 and 2A in its set condition.

Located below slip wedge 52 is a packer element assembly 56, which includes at least one packer element 57 as shown in FIG. 3A or as shown in FIG. 2A may include a plurality of expandable packer elements 58 positioned about packer mandrel 28. Packer element assembly 56 has an unset position shown in FIGS. 1 and 2A and a set position shown in FIG. 3A. Packer element assembly 56 has upper end 60 and lower end 62.

In an embodiment, the packer elements 58 comprise an elastomer. The elastomer may include any suitable elastomeric material that can melt, cool, and solidify onto a high density additive. In an embodiment, the elastomer may be a thermoplastic elastomer (TPE). Without limitation, examples of monomers suitable for use in forming TPEs include dienes such as butadiene, isoprene and hexadiene, and/or monoolefins such as ethylene, butenes, and 1-hexene. In an embodiment, the TPE includes polymers comprising aromatic hydrocarbon monomers and aliphatic dienes. Examples of suitable aromatic hydrocarbon monomers include without limitation styrene, alpha-methyl styrene, and vinyltoluene. In an embodiment, the TPE is a crosslinked or partially crosslinked material. The elastomer may have any particle size compatible with the needs of the process. For example, the particle size may be selected by one of ordinary skill in the art with the benefits of this disclosure to allow for easy passage through standard wellbore servicing devices such as for example pumping or downhole equipment. In an embodiment, the elastomer may have a median particle size, also termed d50, of greater than about 500 microns, alternatively of greater than about 550 microns, and a particle size distribution wherein about 90% of the particles pass through a 30 mesh sieve US series.

In an embodiment, packer element 58 may comprise a resilient material. Herein resilient materials may refer to materials that are able to reduce in volume when exposed to a compressive force and return back to about their normal volume (e.g., pre-compressive force volume) when the compressive force subsides. In an embodiment, the resilient material returns to about the normal volume (e.g., to about 100% of the normal volume) when the compressive force subsides. In an alternative embodiment, the resilient material returns to a high percentage of the normal volume when the compressive force subsides. A high percentage refers to a portion of the normal volume that may be from about 70% to about 99% of the normal volume, alternatively from about 70% to about 85% of the normal volume, and further alternatively from about 85% to about 99% of the normal volume. Such resilient materials may be solids, liquids or gases.

At the lowermost portion of tool 10 is an angled portion, referred to as mule shoe 78, secured to packer mandrel 28 by pin 79. Just above mule shoe 78 is located slip segments 76. Just above slip segments 76 is located slip wedge 72, secured to packer mandrel 28 by shear pin 74. Slip wedge 72 and slip segments 76 may be identical to slip wedge 52 and slip segments 48. The lowermost portion of tool 10 need not be mule shoe 78, but may be any type of section which will serve to prevent downward movement of slips 76 and terminate the structure of the tool 10 or serve to connect the tool 10 with other tools, a valve or tubing, etc. It will be appreciated by those in the art that shear pins 46, 54, and 74, if used at all, are pre-selected to have shear strengths that allow for the tool 10 to be set and deployed and to withstand the forces expected to be encountered in the wellbore 15 during the operation of the tool 10.

Figure 8:
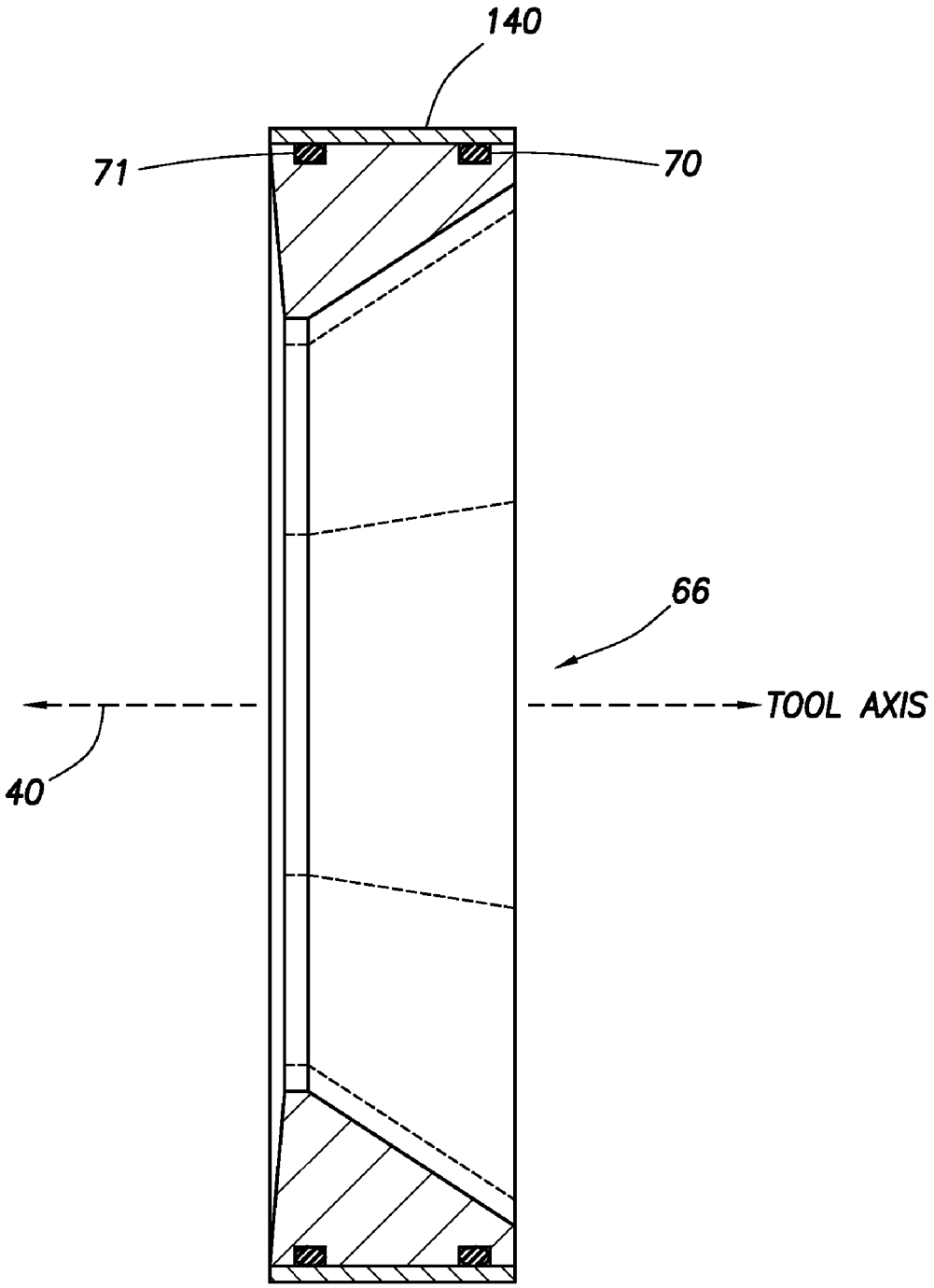
FIG. 8 is a cross sectional illustration of a segmented backup shoe according to an embodiment of the disclosure.

Located just below upper slip wedge 52 is a segmented backup shoe 66. Located just above lower slip wedge 72 is a segmented backup shoe 68. As seen best in FIG. 1, the backup shoes 66 and 68 comprise a plurality of segments, e.g. eight, in this embodiment. The multiple segments of each backup shoe 66, 68 are held together on mandrel 28 by retaining bands 70 carried in circumferential grooves 71 on the outer surface of the backup shoe segments. The bands 70 may be equivalent to the bands 50 used to retain slips 48 in run in position. While FIG. 8 illustrates two bands 70, in another embodiment a different number of bands may be employed, for example a single band, three bands, or yet more bands.

Figure 3B:
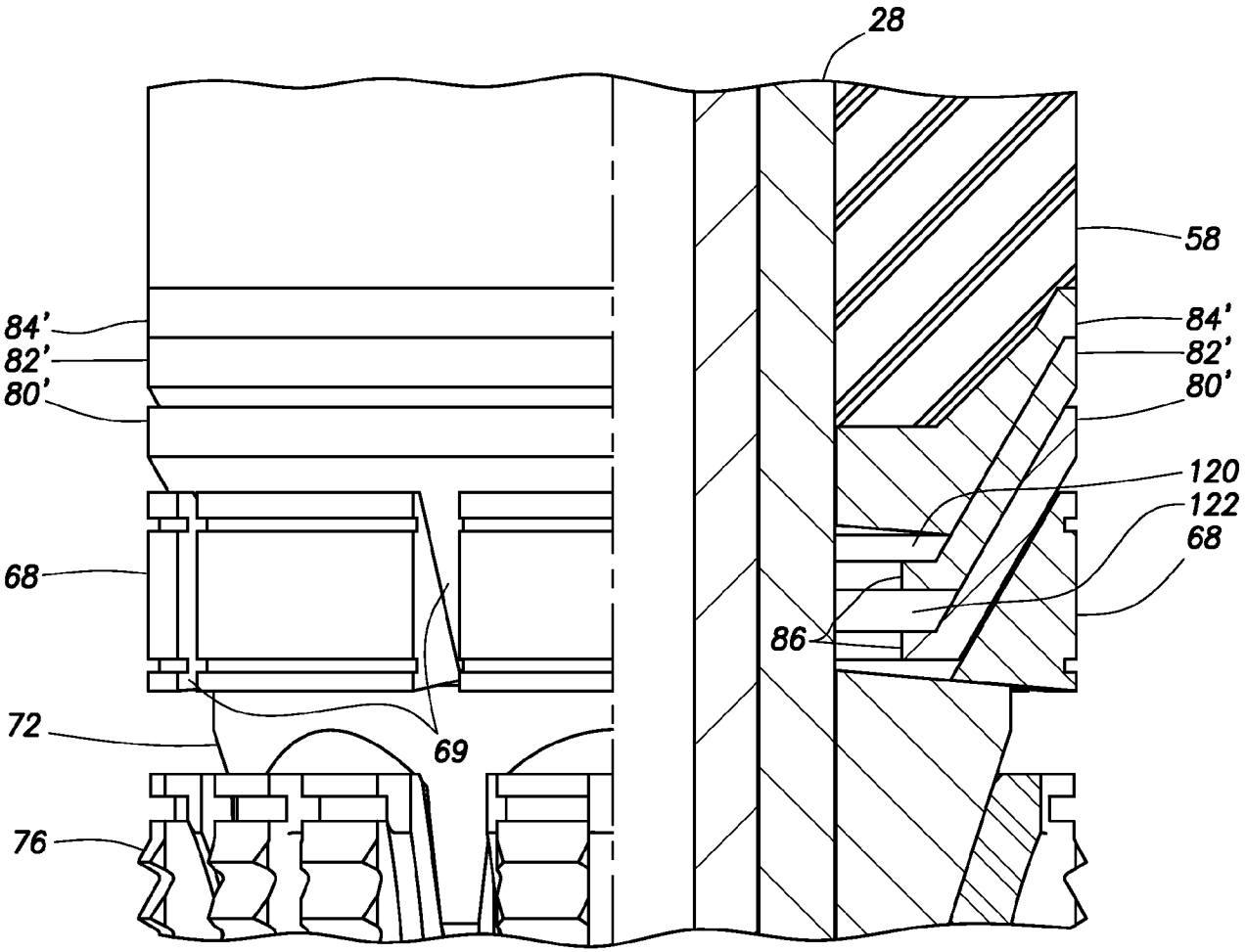
FIG. 3B is an illustration of a portion the bridge plug tool of FIGS. 1, 2 and 2A in its set condition showing details of extrusion limiters.

The elements of the tool 10 described to this point of the disclosure may be considered equivalent to elements of known drillable bridge plugs and/or packers. The known tools have been limited in terms of pressure and temperature capabilities by extrusion of packer elements 57, 58 when set in a wellbore. During setting, as shown in FIGS. 3A and 3B, the segments of segmented backup shoes 66, 68 expand radially generating gaps 67, 69 respectively between the segments. At sufficiently high pressure and temperature conditions, the elastomer normally used to form the packer elements 57, 58 tends to extrude through the gaps 67, 69 leading to damage to the elements 57, 58 and leakage of well fluids past the tool 10. The present disclosure provides several embodiments that resist such element extrusion and have substantially increased the pressure rating of the tool 10 at high temperature while being simple, inexpensive and easy to build and install.

With reference to FIGS. 1-3B, an embodiment includes three extrusion limiting elements positioned between the upper backup shoe 66 and the upper end 60 of the packer elements, and three extrusion limiting elements positioned between the lower backup shoe 68 and the lower end 62 of the packer elements 57, 58. Two split cone extrusion limiters 80 and 82 are stacked together and positioned adjacent the upper segmented backup shoe 66. Between split cone 82 and the upper end 60 of packer elements 58 is positioned a solid retaining ring 84. At the lower end 62 of the packer elements 58 are located identical split cone extrusion limiters 80' and 82' and a solid retaining ring 84'. In alternative embodiments only one of the split cone extrusion limiters 80, 82 is used at each end of the packer elements 57, 58 or both split cone extrusion limiters are used without the solid retaining ring 84. However, it is preferred to use both split cone extrusion limiters 80, 82 and the solid retaining ring 84 at both ends of the packer elements 57, 58.

Figure 4C:
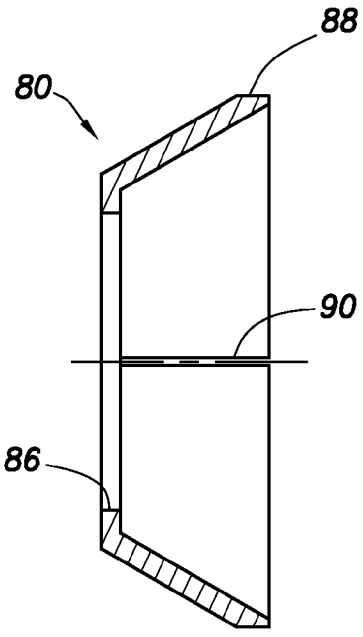
FIGS. 4A, 4B and 4C are side, plan and cross sectional illustrations of a split cone extrusion limiter according to an embodiment.
Figure 4B:
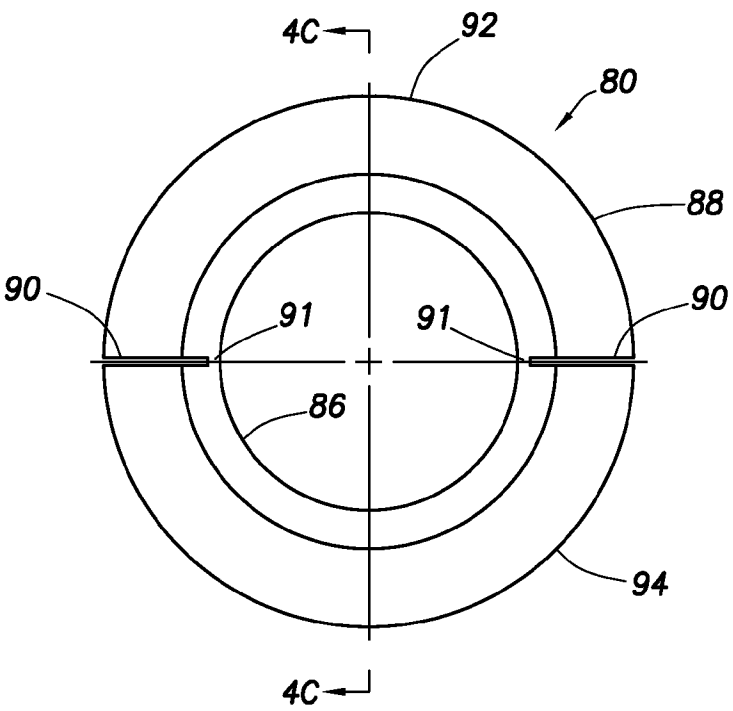
Figure 4A:
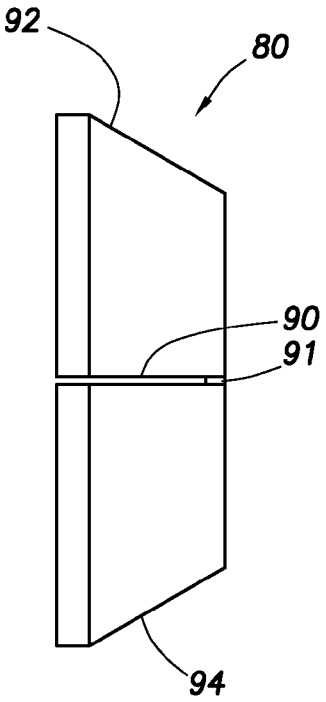

FIGS. 4A, 4B, 4C illustrate more details of the split cone extrusion limiter 80. Extrusion limiter 82 may be identical to extrusion limiter 80. The extrusion limiter 80 may be essentially a simple section of a hollow cone having an inner diameter at 86 sized to fit onto the mandrel 28 and an outer diameter at 88 corresponding to the outer diameter of tool 10 in its run in condition shown in FIGS. 1 and 2. The extrusion limiter 80 is preferably made of a non-metallic material such as a fiber-reinforced polymer composite. The composite is preferably reinforced with "E" glass fibers, "S" glass fibers, graphite fibers, or other fibers. Such composites are commonly referred to as fiberglass. However the extrusion limiter 80 may be made of other engineering plastics if desired. Such materials have high strength and are flexible.

The split cone extrusion limiter 80 may be conveniently made by forming a radially continuous cone equivalent to a funnel and then cutting two gaps 90 to form two separate half cones 92, 94. In this embodiment, the gaps 90 are not cut completely through to the inner diameter 86 of the split cone 80. Small amounts of material remain at the inner diameter 86 at each gap 90 forming releasable couplings 91 between the half cones 92, 94. By leaving the half cones 92, 94 weakly attached, assembly of the tool 10 is facilitated. Upon setting of the tool 10 in a wellbore, the releasable couplings 91 break and the half cones 92, 94 separate and perform their extrusion limiting function as separate elements. Alternatively, the cone halves 92, 94 may be fabricated separately and each half may be identical to the other. Bands, like bands 50 and 70 could then be used to assemble two half cones onto the mandrel as shown in FIGS. 1 and 2A, for running the bridge plug 10 into a well. In another alternative, the bands 70 and segmented backup shoes 66 and 68 may hold the separate half cones 92, 94 in run in position once the bridge plug is assembled as shown in FIG. 2A.

Figure 5:
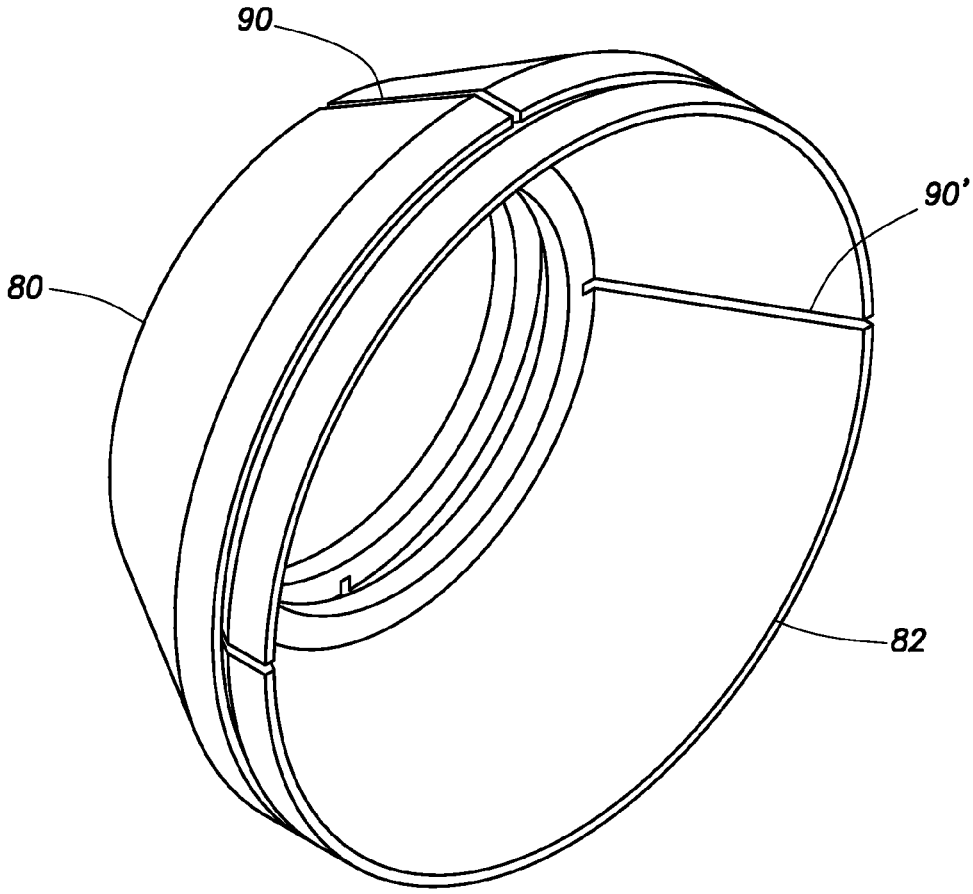
FIG. 5 is a perspective view of two split cone extrusion limiters stacked for assembly into the tool of FIGS. 1 and 2.

FIG. 5 illustrates the assembly of two split cone extrusion limiters 80 and 82 in preparation for assembly onto the mandrel 28. The gaps 90 of extrusion limiter 80 are intentionally misaligned with the gaps 90' of extrusion limiter 82 and preferably positioned about ninety degrees from the position of gaps 90' of extrusion limiter 82. Each limiter 80, 82 therefore resists extrusion of packer elements 58 through gaps 90, 90' of the other limiter. The two limiters 80, 82 together form a continuous extrusion limiting cone resisting extrusion of the packer elements 57, 58 through gaps 67, 69 between segments of the segmented backup shoes 66, 68.

Figure 7:
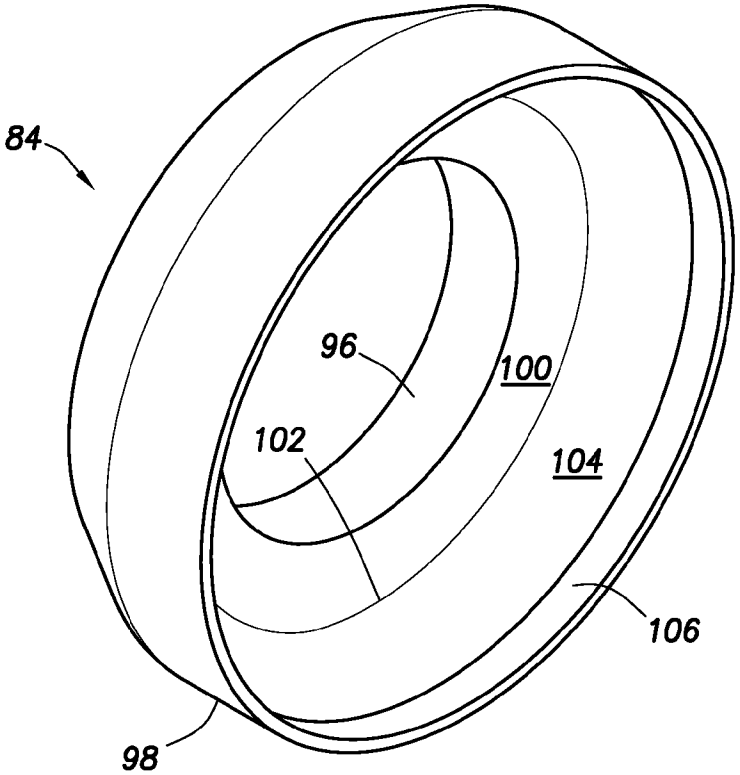
FIG. 7 is a perspective view of the solid retaining ring.
Figure 6:
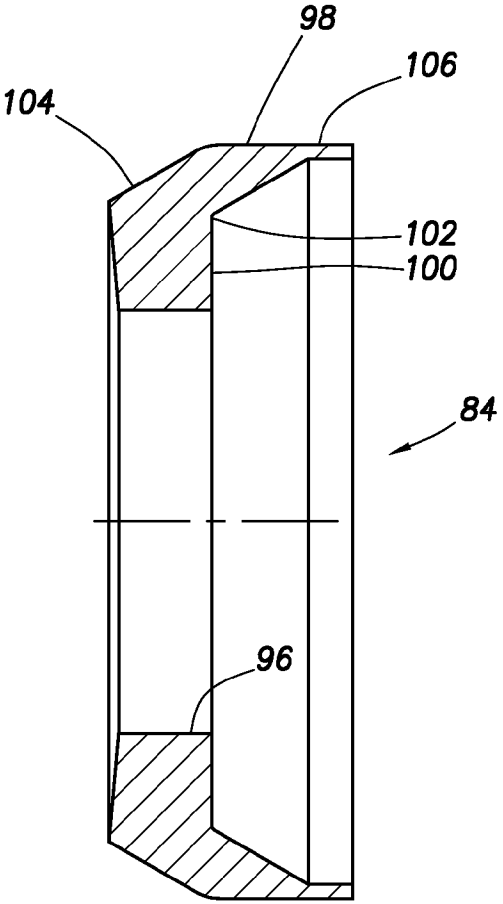
FIG. 6 is a cross sectional illustration of a solid retaining ring.

FIGS. 6 and 7 are illustrations of the solid retaining rings 84, 84'. Retaining rings 84, 84' are referred to herein as solid because they are not segmented like backup shoes 66, 68 and are not split like the split cone extrusion limiters 80, 82. The retaining rings 84, 84' are continuous rings having an inner diameter 96 sized to fit onto the mandrel 28 and an outer diameter 98 about equal to the run in diameter of the bridge plug 10. The retaining rings 84, 84' are thicker at the inner diameter and taper to a thin edge at the outer diameter. The retaining rings 84, 84' are preferably made of a material that can be expanded, but does not extrude as easily as the packer elements 57, 58. A suitable material is polytetrafluoroethylene, PTFE.

Retaining rings 84, 84' in this embodiment have three sections each having different shape and thickness. A first inner section 100, extending from the inner diameter 96 to an intermediate diameter 102 has an essentially flat disk shape and is the thickest section. A second section 104 extending from the intermediate diameter 102 to the full run in diameter 98 has a conical shape and is thinner than the first section. The third section 106 is essentially cylindrical, extends from the second section 104, has an outer diameter 98 equal to the run in diameter of tool 10, and is thinner than the second section 104. The differences in thickness of the three sections facilitate expansion and flexing of the second and third sections as the tool 10 is set in a borehole.

As seen best in FIGS. 2A and 2B, the conical second section 104 of retainers 84, 84' have about the same angle relative to the axis 40 of tool 10 as do the ends 60, 62 of packer elements 57, 58, the split cone extrusion limiters 80, 82 and inner surfaces 108 of the segmented backup shoes 66, 68. In an embodiment, this angle may be about thirty degrees relative to the central axis 40. The cross section of backup shoes 66, 68 is essentially triangular including the inner surfaces 108 and an outer surface 110 which is essentially cylindrical and in the run in condition has about the same diameter as other elements of the tool 10. The shoes 66, 58 have a third side 112 which abuts a slightly slanted surface 114 of the slip wedges 52, 72. The slant of third side 112 and the slip wedge surface 114 is preferably about five degrees from perpendicular to the central axis 40.

With reference to FIGS. 1, 2A, 2B, 3A and 3B, operation of the tool 10 will be described. The tool 10 in the FIG. 2A, 2B run in condition is typically lowered into, i.e. run in, a well by means of a work string of tubing sections or coiled tubing attached to the upper end 116 of the tool. A setting tool, not shown but well known in the art, is part of the work string. When the tool 10 is at a desired depth in the well, the setting tool is actuated and it drives the spacer ring 44 from its run in position, FIG. 2A, to the set position shown in FIG. 3A. As this is done, the shear pins 46, 54, and 74 are sheared. The slips 48, 76 slide up the slip wedges 52, 72 and are pressed into gripping contact with the casing 22, or borehole wall 15 if the well is not cased.

The force applied to set the wedges 52, 72 is also applied to the packer elements 57, 58 so that they expand into sealing contact with the casing 22, or borehole wall 15 if the well is not cased. The forces are also applied to the backup shoes 66, 68, the split cone extrusion limiters 80, 82, 80', 82' and to the solid retaining rings 84, 84'. Due to the slanted surfaces of these parts, the backup shoes 66, 68 expand radially and the gaps 67, 69 between the segments open, as seen best in FIGS. 3A, 3B. The split cone extrusion limiters 80, 82, 80', 82' expand radially away from the mandrel 28 with the backup shoes 66, 68 and resist extrusion of the elements 57, 58 through the gaps 67, 69. If the split cone extrusion limiters 80, 82, 80', 82' were made according to FIGS. 4 and 5, the small releasable couplings 91 are broken so that each half cone portion 92, 94 expands radially away from its corresponding half cone portion. However, the angle of the cones relative to the axis 40 of the tool 10 is essentially unchanged from the run in condition to the set condition.

Since the retaining rings 84, 84' are not split or segmented, they do not expand radially in the same way as the backup shoes 66, 68 and the split cone extrusion limiters 80, 82, 80', 82'. However, the tapered shape of the retaining rings 84, 84' allows the second section 104 and third section 106 of the retaining rings to expand to the set diameter of tool 10 by stretching and bending. As the setting process occurs and the retaining rings 84, 84' expand and bend, the pairs of split cone extrusion limiters 82, 82' effectively slide up the outer surface of the retaining rings 84, 84', providing support to the retaining rings 84, 84' and limiting expansion thereof. The pairs of split cone extrusion limiters 80, 80' expand radially away from mandrel 28 with the pairs of split cone extrusion limiters 82, 82'. At the same time, the retaining rings 84, 84' flow into and seal the gaps 90' (FIG. 5) in the split cone extrusion limiters 82, 82'. If this flow does not occur during setting of the tool 10, it may occur when the tool is exposed to high pressure differential in the well 15. The retaining rings 84, 84' are preferably made of PTFE or an equivalent material that can extrude to some extent, but not to the extent that elastomers used for packer elements 57, 58 do at high temperature and high pressure.

The exploded, or blown up, views of FIGS. 2B and 3B show details of the setting process for the tool 10. In the run in condition of FIG. 2B, an axial space 118 is provided between the packer element 58 and the first section 100 of the retaining ring 84'. An axial space 120 is provided between the first section 100 of the retaining ring 84' and the split cone extrusion limiter 82'. An axial space 122 is provided between the split cone extrusion limiter 82' and the split cone extrusion limiter 80'. The inner diameter 96 of retaining ring 84 and inner diameters 86 of split cone extrusion limiters 80' and 82' are all near or in contact with the mandrel 28.

In the set condition of FIG. 3B, it can be seen that the space 118 has been filled with a portion of the packer element 58 as the packer element 58 and retaining ring 84' expanded to the set diameter. The space 120 has been reduced as the split cone extrusion limiter 82' expanded radially and effectively slid up the outer surface of the retaining ring 84'. Split cone extrusion limiter 80' has also expanded radially and remained in contact with the split cone extrusion limiter 82' and the backup shoe 68. The inner diameters 86 of the split cone extrusion limiters 80' and 82' are now radially displaced from the mandrel 28. The inner diameter 96 of retaining ring 84' remains essentially in contact with the mandrel 28, and its outer diameter 106 has expanded by expansion and bending of the retaining ring 84'.

Segmented backup shoes 66, 68 may be made of a glass fiber and/or graphite fiber reinforced phenolic and/or epoxy material available from General Plastics & Rubber Company, Inc., 5727 Ledbetter, Houston, Tex. 77087-4095, which includes a direction-specific laminate material referred to as GP-B35F6E21K. Alternatively, structural phenolics available from commercial suppliers may be used. In an embodiment, the segmented backup shoes 66, 68 may be made of a composite material. Split cone extrusion limiters 80, 84, 80', 84' may be made of a composite material available from General Plastics & Rubber Company, Inc., 5727 Ledbetter, Houston, Tex. 77087-4095. A particularly suitable material includes a direction specific composite material referred to as GP-L45425E7K available from General Plastics & Rubber Company, Inc. Alternatively, fiber reinforced phenolics, fiber reinforced epoxies, and/or other fiber reinforced thermoset material available from other commercial suppliers may be used to make segmented backup shoes 66, 68.

Turning now to FIG. 8, further details of the segmented backup shoes 66, 68 are discussed. While the segmented backup shoe 66 is illustrated in FIG. 8, it is understood that the description below is also applicable to the segmented backup shoe 68. The segmented backup shoe 66 may comprise from six to fourteen separate segments. In an embodiment, the retaining bands 70 disposed within circumferential grooves 71 may be comprised of fiberglass and/or graphite reinforced epoxy, but in another embodiment another material may be used. When the segmented backup shoe 66 is expanded, the retaining bands 70 break and/or rupture. An expandable band 140 circumferentially encloses the segmented backup shoe 66. As illustrated, the expandable band 140 may be said to substantially cover the outer circumferential surface of the segmented backup shoe 66 in an initial condition, for example, before the bridge plug 10 is run in. As illustrated, the expandable band 140 may be said to continuously cover the outer circumferential surface of the segmented backup shoe 66 in an initial condition, for example, before the bridge plug 10 is run in. During run-in of the bridge plug 10, the expandable band 140 may rip or wear in some places, thereby exposing the surface of the segmented backup shoe 66. While in FIG. 8 the expandable band 140 is shown extending from a left outer circumferential edge to a right outer circumferential edge of the segmented backup shoe 66, in an alternative embodiment the expandable band 140 may extend any distance (e.g., all or a portion of the distance) between the left to the right outer circumferential edge of the segmented backup shoe 66 and may be positioned at any orientation along the distance (e.g., abutting the left outer circumferential edge, abutting the right outer circumferential edge, centered, etc.). In an embodiment, the expandable band 140 may be at least 5 times as wide as the sum of the widths of the retaining bands 70. In an embodiment, the expandable band 140 may be at least 10 times as wide as the sum of the widths of the retaining bands 70. In an embodiment, the expandable band 140 may have a thickness that is less than ⅓ the thickness of the retaining bands 70. In an embodiment, the expandable band 140 may extend over one or more of the circumferential edges of the segmented backup shoe 66.

In an embodiment, the expandable band 140 expands but does not rupture during expansion of the segmented backup shoe 66. Alternatively, in an embodiment, the expandable band 140 ruptures during expansion of the segmented backup shoe 66. For example, the expandable band 140 may expand within limits and then rupture when those limits are exceeded. In an embodiment, the segmented backup shoe 66 does not comprise the circumferential grooves 71 and does not comprise the retaining bands 70. In this embodiment, the expandable band 140 may provide the function of holding the plurality of segments of the segmented backup shoe 66 together during the run-in of the bridge plug 10.

The expandable band 140 may be formed of an elastomer, for example an elastomer as characterized above with reference to the packer element assembly 56. The expandable band 140 may be formed of a high stretch rate rubber such as silicon rubber. The expandable band 140 may be formed of nitrile rubber. The expandable band 140 may be formed of other elastomers. In combination with the present disclosure, one skilled in the art will be able to choose a suitable elastomeric material based on the relative importance of the stretchability versus the wear resistance of the expandable band 140. In a preferred embodiment the expandable band 140 may have a thickness of about 0.010 inches to about 0.090 inches. In other embodiments, however, the expandable band 140 may have a different thickness. The expandable band may have a uniform thickness, or a non-uniform thickness. In an embodiment, a leading edge of the expandable band is thicker than a trailing edge based upon a run-in orientation of the bridge plug 10.

The expandable band 140 may be coated or molded onto the segmented backup shoe 66. In an embodiment, the expandable band 140 is inserted first into a mold, and the backup shoe 66 is further formed with the expandable band 140 in place (e.g., composite material forming the backup shoe 66 is injected into the mold containing the expandable band 140). In another embodiment, the backup shoe 66 is formed (e.g., composite material forming the backup shoe 66 is injected into a mold) and a further material forming the expandable band 140 (e.g., an elastomeric material) is injected into the mold, thereby forming the expandable band 140 around the backup shoe 66. Alternatively, the expandable band 140 may be manufactured as a separate component that is installed over the segmented backup shoe 66, for example by expanding, pulling over the segmented backup shoe 66, and then de-expanding (e.g., releasing) it.

In an embodiment, the expandable band 140 protects the retaining bands 70 during run-in of the bridge plug 10. Additionally, the expandable band 140 may prevent the retaining bands 70, upon rupturing, from moving freely about and thereby undesirably impacting other components of the bridge plug 10 during expansion of the segmented backup shoe 66. In an embodiment, the expandable band 140 may promote the omission of one or more (e.g., all) of the retaining bands 70 and the circumferential grooves 71 from the segmented backup shoe 66. The expandable band 140 promotes the segmented backup shoe 66 moving as a unit during expansion. Additionally, the expandable band 140 may promote even spacing of the several segments of the segmented backup shoe 66 during run-in of the bridge plug 10 and as the segmented backup shoe 66 expands.

In some embodiments, the expandable band 140 may resist and/or mitigate extrusion of the packing element 58 between the segments of the segmented backup shoe 66 (e.g., prevent extrusion into gaps 69), thereby promoting enhanced sealing of the packing element assembly 56. For example, when the packing element 58 is heated in the down hole environment of the wellbore 15 there may be a tendency for the packing element 58 to extrude through the gaps 69 between the segments of the segmented backup shoe 66, and the expandable band 140 may resist and/or mitigate this extrusion by at least partially filling and/or obstructing the gaps 69.

Figure 9A:
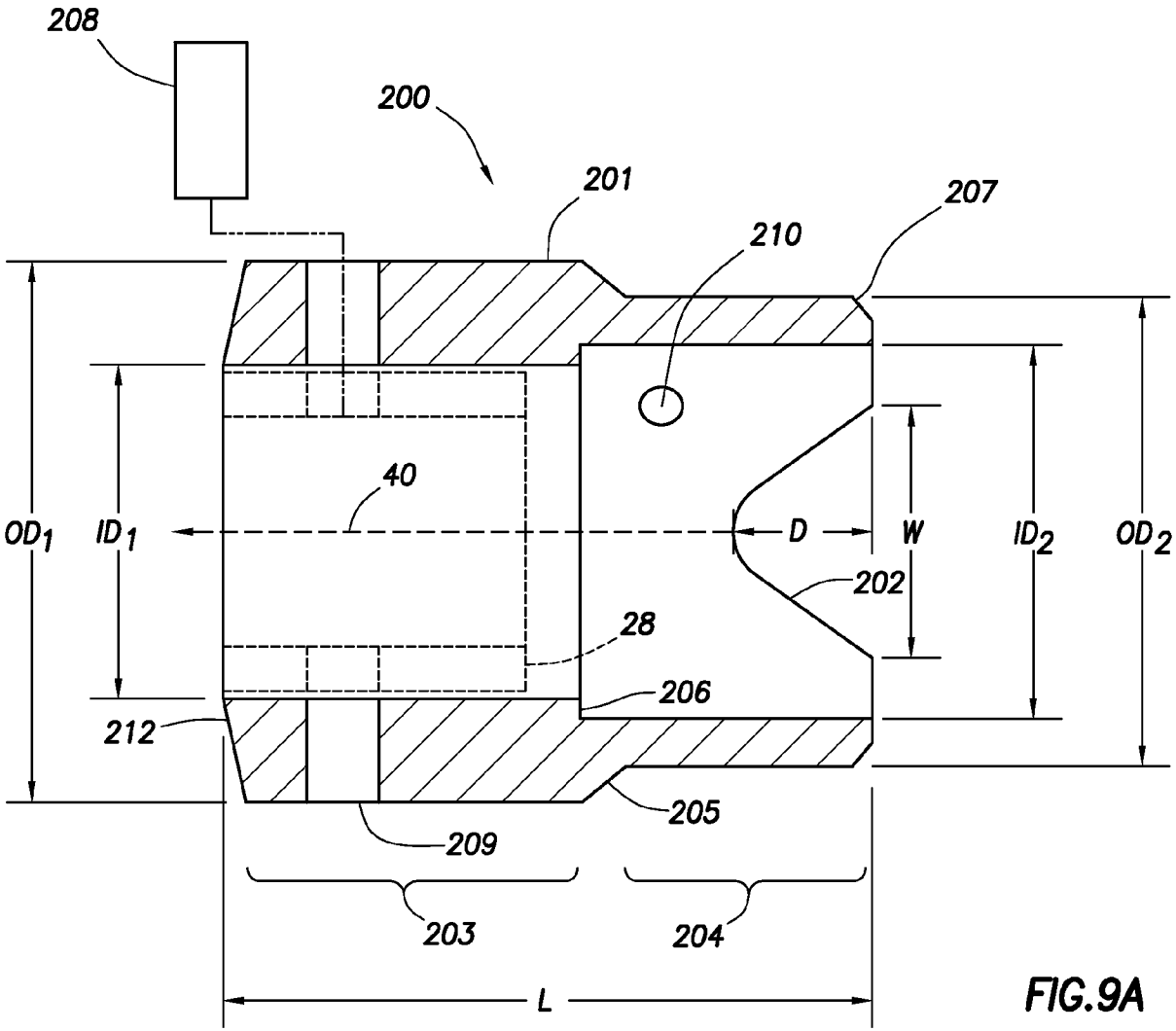
FIG. 9A is cross sectional illustration of an end component according to an embodiment of the disclosure.
Figure 9B:
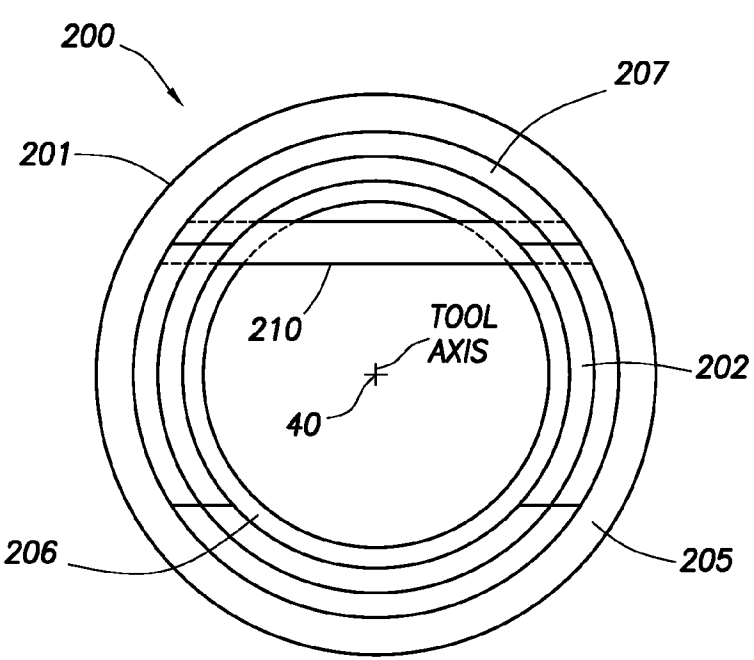
FIG. 9B is an illustration of an end component according to an embodiment of the disclosure.
Figure 9C:
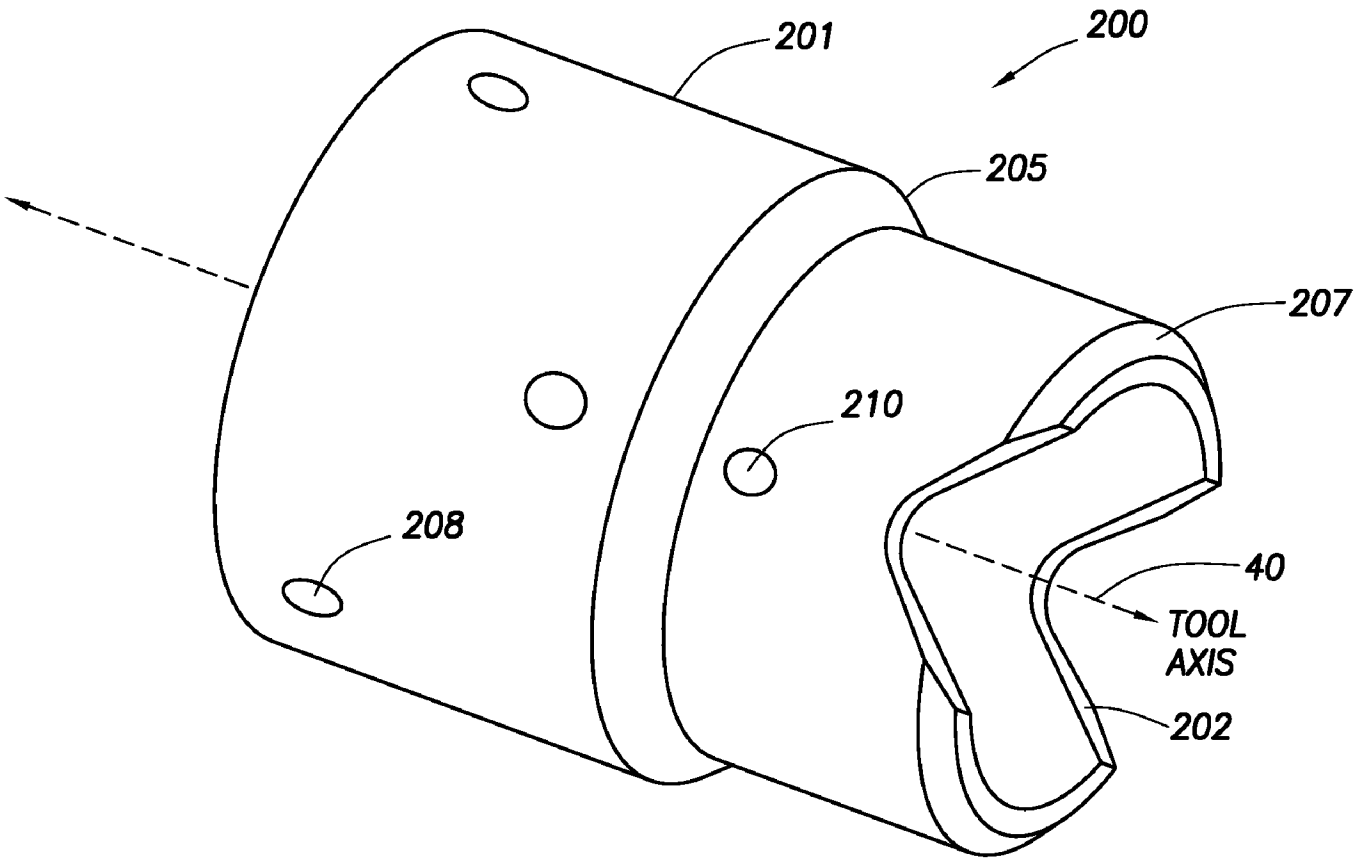
FIG. 9C is a perspective illustration of an end component according of an embodiment of the disclosure.

Turning now to FIG. 9A, FIG. 9B, and FIG. 9C an end component 200 is described. FIG. 9A shows an axial cross section of the end component 200. FIG. 9B shows a lateral cross section of the end component 200. FIG. 9C shows a perspective view of the end component 200. The various features of the end component 200 described in detail below may be seen to greater advantage in one or another of these three figures. In some embodiments, the end component 200 may suitably replace the mule shoe 78 on the downhole end of the bridge plug embodiment 10. The end component 200 is comprised of drillable and/or millable material. In an embodiment, the end component 200 may be shorter and comprise less volume of material than the mule shoe 78, thereby making the end component 200 easier to drill out.

The end component comprises a cylindrical shell 201 that defines a first notch 202 at its down hole end. In FIG. 9A, the direction along the axis 40 to the right is down hole and the direction along the axis 40 to the left is uphole. In an embodiment, the cylindrical shell 201 may be comprised of composite material. The notch 202 may take a variety of shapes. In an embodiment, the notch 202 is comprised of a smooth curve, for example a sinusoidal or bell curve. In an embodiment, the first notch 202 may have a V-shape with a radiused bottom where the straight sides make about a 45 degree angle with the axis 40 of the end component 200. In an embodiment, the cylindrical shell 201 defines two notches at its downhole end, wherein a center of a second notch is located about 180 degrees circumferentially away from a center of the first notch 202. The second notch may be substantially similar to the first notch 202.

A width, W, of the first notch 202 may be at least 10 percent and less than 40 percent of the circumference of the downhole edge of the cylindrical shell 201. A depth, D, of the first notch 202 may be at least 10 percent of the length, L, of the cylindrical shell 201. For example, a down hole edge of the cylindrical shell 201 may have an outside diameter of about 3.25 inches with a corresponding circumference of about 10.2 inches and a length, L, of about 4.5 inches. In this example, the notch 202 may be about 1.75 inches in arc length (about 17 percent of the circumference) and about 0.9 inches deep (about 20 percent of the length). The first notch 202 may be sized, shaped, and/or positioned to promote restoring a fracturing ball onto a seat of another bridge plug that may be located downhole of the bridge plug 10.

In an embodiment, the cylindrical shell 201 has an uphole portion 203 having a first outside diameter $OD_1$ and a first inside diameter $ID_1$ and a downhole portion 204 having a second outside diameter $OD_2$ and a second inside diameter $ID_2$. In an embodiment, the first outside diameter $OD_1$ is greater than the second outside diameter $OD_2$. In an embodiment, the first inside diameter $ID_1$ is less than the second inside diameter $ID_2$. An exterior sloped shoulder 205 of the cylindrical shell 201 is formed where the greater diameter $OD_1$ transitions to the lesser diameter $OD_2$ of the cylindrical shell 201. The sloped shoulder 205 may promote ease of travel of the end component 200 and more generally the bridge plug 10 into the wellbore 15. An interior shoulder 206 of the cylindrical shell 201 is formed where the lesser inside diameter $ID_1$ transitions to the greater inside diameter $ID_2$. The reduction of outside diameter as well as the increased inside diameter in the downhole portion 204 of the cylindrical shell 201 reduces the volume of material that may be drilled out when the bridge plug 10 has completed its useful service.

The first outside diameter $OD_1$ of the cylindrical shell 201 may be determined so that the uphole portion 203 has a diameter equal to or slightly greater than the diameter of the slips segments 76 in a run-in condition, to protect the slip segments 76 from damage caused by bumping the wellbore 15 and/or casing 22. The second inside diameter $ID_2$ of the cylindrical shell 201 may be determined to fit suitably over a portion of a tool located downhole of the end component 200 in the wellbore, for example a mandrel or ball seat of a separate bridge plug located downhole of the bridge plug 10.

The outer circumferential side of the downhole edge of the cylindrical shell 201 may be beveled. The beveled downhole edge 207 may promote ease of travel of the end component 200 as well as the bridge plug 10 into the wellbore 15, for example passing over casing collars or casing joints. The end component 200 may be secured to the packer mandrel 28 with a plurality of pins 208 held in holes 209 through the wall of the uphole portion 203 of the cylindrical shell 201. While one pin is shown in FIG. 9A, in an embodiment a plurality of pins (e.g., four pins) similar to pin 208 may be used to secure the end component 200 to the packer mandrel 28. In an embodiment, the four pins may be located in a plane about 90 degrees apart from each other on a circumference of the cylindrical shell 201. In an embodiment, eight pins similar to pin 208 may be used to secure the end component 200 to the packer mandrel 28—a first set of four pins in a first plane and a second set of four pins in a second plane that is parallel to the first plane, where the pins in the second plane are offset circumferentially by 45 degrees with reference to the pins in the first plane.

The end component 200 may comprise a pivot pin 210 that is held by two holes through the wall of the downhole portion 204 of the cylindrical shell 201. The pivot pin 210 does not pass through the packer mandrel 28. As best shown in FIG. 9B, the pivot pin 210 is offset from the axis 40 of the end component 200 and does not pass through the axis 40. The pivot pin 210 may promote causing the end component 200 to pivot about pivot pin 210 when downhole force is applied to the packer mandrel 28 and/or the end component 200, whereby the end component 200 may bind or bite into a mandrel, wellbore wall (e.g., casing 20), and/or other component located downhole of the end component 200 in the wellbore 15. The binding of the end component 200 with the mandrel or other component located downhole of the end component 200 may promote ease of removal (e.g., drilling and/or milling) of the end component 200, because the binding may reduce or stop the end component 200 from rotating freely in the wellbore 15 in response to the rotational motion applied to it. The uphole portion 203 of the cylindrical shell 201 may have a sloped edge face 212 where the cylindrical shell 201 abuts with the slips segments 76.

Figure 10A:
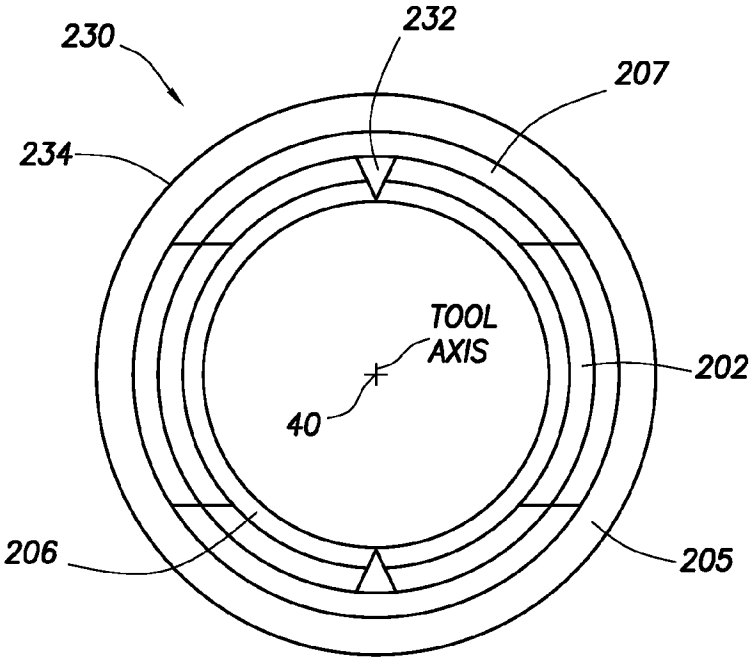
FIG. 10A is an illustration of an end component according to an embodiment of the disclosure.
Figure 10B:
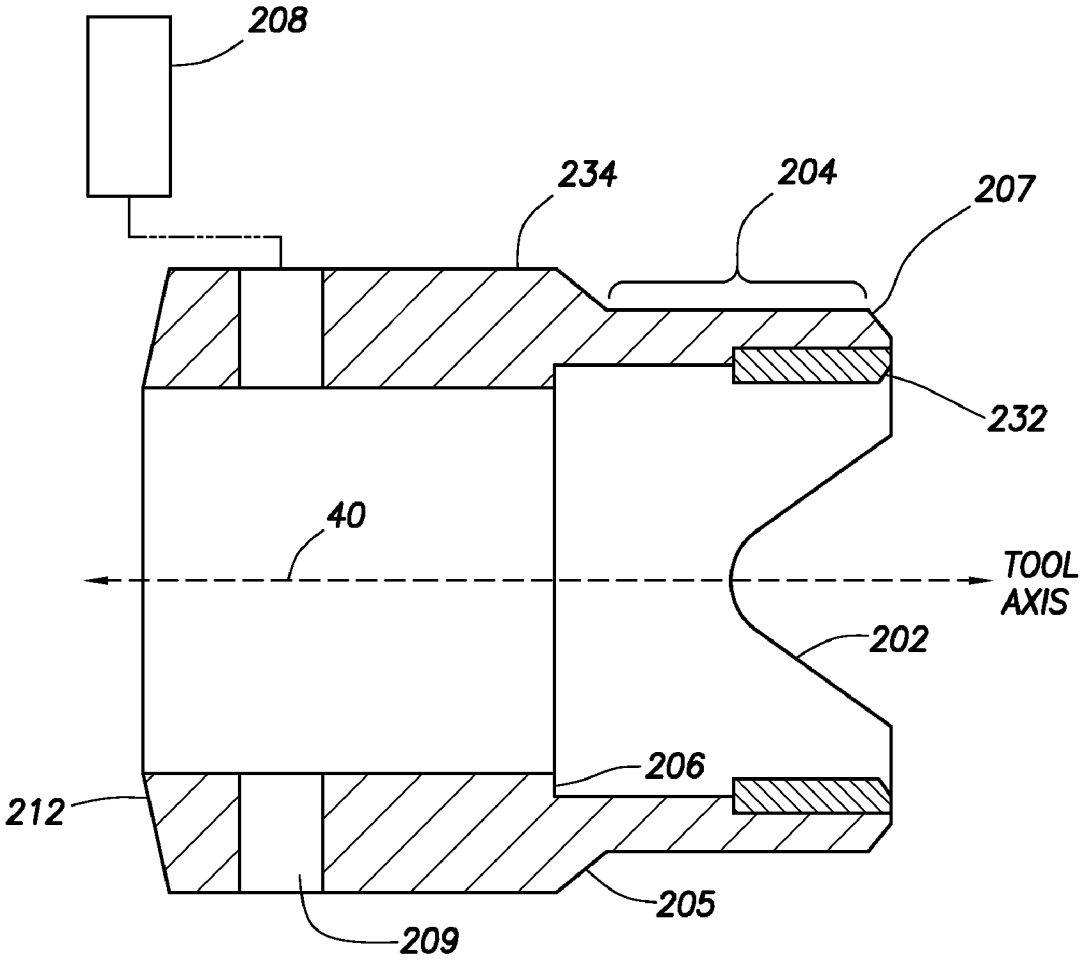
FIG. 10B is an illustration of an end component according to an embodiment of the disclosure.

Turning now to FIG. 10A and FIG. 10B, an end component 230 is described. The features of the end component 230 described in further detail below may be seen to advantage in one or the other of these two figures. In an embodiment, the end component 230 may suitably replace the mule shoe 78 on the downhole end of the bridge plug embodiment 10. The end component 230 is substantially similar to the end component 200, with the exception that the pivot pin 210 is omitted and at least one insert 232 is coupled to the inside of the downhole portion 204 of a cylindrical shell 234. The insert 232 may take a variety of forms, including a triangular column as shown in FIG. 10A and FIG. 10B. The insert 232 promotes the downhole portion 204 of the cylindrical shell 234 gripping a portion of a mandrel or other component located downhole of the end component 200 in the wellbore 15, thereby preventing the end component 230 from rotating freely in the wellbore 15 in response to the drilling or milling motion applied to it. The insert 232 may have an irregular or rough texture to promote gripping. In an embodiment, the end component 230 omits the notch 202. In an embodiment the insert 232 may comprise ceramic material, metal material, or other strong material. In an embodiment, the insert 232 may comprise carbide material. In an embodiment, the end component 230 comprises two inserts 232. In another embodiment, the end component 230 may comprise one insert 232 or more than two inserts 232. As best seen in FIG. 10B, the insert 232 may extend into the downhole portion 204 of the end component 230.

Figure 10C:
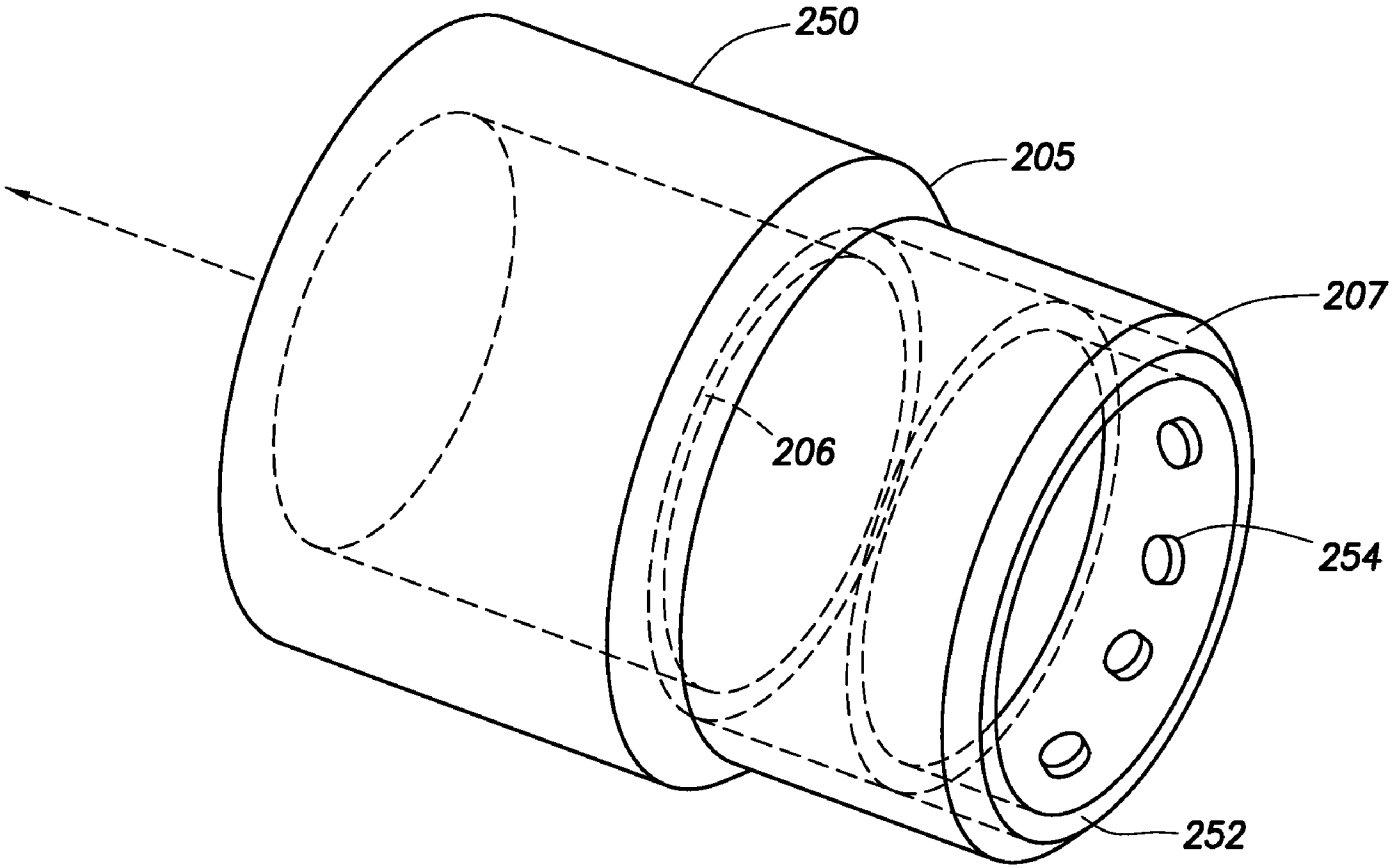
FIG. 10C is an illustration of an end component according to an embodiment of the disclosure.

Turning now to FIG. 10C, an end component 250 is described. In an embodiment, the end component 250 may suitably replace the mule shoe 78 on the downhole end of the bridge plug embodiment 10. The end component 250 may be substantially similar to the end component 200 and/or the end component 230, with the exception that the end component 250 does not comprise the notch 202, does not comprise pivot pin 210, comprises insert retaining body 252, and comprises inserts 254 coupled to the insert retaining body 252. In an embodiment, the inserts 254 are oval or circular in cross section and project into the interior of the downhole portion of the end component 250. In an embodiment, the inserts 254 are mounted at an angle with reference to the inside surface of the end component 250 to better grip a mandrel or other component located downhole of the end component 250 in the wellbore 15. The inserts 254 may have an irregular or rough texture to promote gripping. The inserts 254 may be comprised of ceramic, metal, or some other strong material. In an embodiment, the inserts 254 may be made of carbide material.

EXAMPLES

Two different embodiments of the expandable band 140 described above were fabricated and tested. Five expandable bands 140 for use with the segmented backup shoe 66, 68 having a 5½ inch outside diameter were fabricated of 70 Durometer Nitrile Rubber, and five expandable bands 140 for use with the segmented backup shoe 66, 68 having a 5½ inch outside diameter were fabricated of 60 Durometer Silicone Rubber. Prior to testing, all parts were heated to about 325 degree Fahrenheit.

In a first test, the outer surface of the segmented backup shoe 66, 68 was abraded for bond to rubber, two retaining bands 70 were disposed within circumferential grooves 71, a first 70 Durometer Nitrile Rubber expandable band 140 was fitted over the segmented backup shoe 66, 68, and a release agent was applied over the expandable band 140 to prevent rubber bond. When about 650 pounds force was applied to the packer including the segmented backup shoe 66, 68 and the expandable band 140, the packer experienced ¼ inch of compressive travel, the expandable band 140 began to tear equally at the joint between each segmented backup shoe 66, 68, the retaining band 70 closest to the packer is broken while the retaining band 70 away from the packer is unbroken, and the segments of the segmented backup shoe 66, 68 experienced equal spread. When about 1250 pounds force was applied to the packer, the packer experienced ½ inch of compressive travel, the tears in the expandable band 140 at the joint between each segmented backup shoe 66, 68 lengthened and remained equal, the retaining band 70 away from the packer remains unbroken, and the segments of the segmented backup shoe 66, 68 still experienced equal spread.

In a second test, the outer surface of the segmented backup shoe 66, 68 was abraded for bond to rubber, two retaining bands 70 were disposed within circumferential grooves 71, a second 70 Durometer Nitrile Rubber expandable band 140 was fitted over the segmented backup shoe 66, 68, and a release agent was applied over the expandable band 140 to prevent rubber bond. When about 650 pounds force was applied to the packer including the segmented backup shoe 66, 68 and the expandable band 140, the packer experienced ⅜ inch of compressive travel, the expandable band 140 began to tear equally at the joint between each segmented backup shoe 66, 68, the retaining band 70 closest to the packer is broken while the retaining band 70 away from the packer is unbroken, and the segments of the segmented backup shoe 66, 68 experienced equal spread. When about 1250 pounds force was applied to the packer, the packer experienced ½ inch of compressive travel, the tears in the expandable band 140 at the joint between each segmented backup shoe 66, 68 lengthened and remained equal, the retaining band 70 away from the packer remains unbroken, and the segments of the segmented backup shoe 66, 68 still experienced equal spread. When about 2500 pounds force was applied to the packer, the packer experienced 1⅛ inch compressive travel, the expandable band 140 tear completely through at the joint between each segmented backup shoe 66, 68, the retaining band 70 away from the packer is now broken, and the segments of the segmented backup shoe 66, 68 still experienced equal spread.

In a third test, the outer surface of the segmented backup shoe 66, 68 was abraded for bond to rubber, two retaining bands 70 were disposed within circumferential grooves 71, a first 60 Durometer Nitrile Rubber expandable band 140 was fitted over the segmented backup shoe 66, 68, and a release agent was applied over the expandable band 140 to prevent rubber bond. When about 1200 pounds force was applied to the packer including the segmented backup shoe 66, 68 and the expandable band 140, the packer experienced ¼ inch of compressive travel, the expandable band 140 began to tear equally but minutely at the joint between each segmented backup shoe 66, 68, the retaining band 70 closest to the packer is broken while the retaining band 70 away from the packer is unbroken, and the segments of the segmented backup shoe 66, 68 experienced equal spread. When about 2500 pounds force was applied to the packer, the packer experienced 1 inch of compressive travel, the tears in the expandable band 140 at the joint between each segmented backup shoe 66, 68 remained equal and minute, the retaining band 70 away from the packer does not appear to be broken, and the segments of the segmented backup shoe 66, 68 still experienced equal spread.

In a fourth test, the outer surface of the segmented backup shoe 66, 68 was abraded for bond to rubber, two retaining bands 70 were disposed within circumferential grooves 71, a second 60 Durometer Nitrile Rubber expandable band 140 was fitted over the segmented backup shoe 66, 68, and a release agent was applied over the expandable band 140 to prevent rubber bond. When about 1250 pounds force was applied to the packer including the segmented backup shoe 66, 68 and the expandable band 140, the packer experienced ⅜ inch of compressive travel, the expandable band 140 began to tear equally and minutely at the joint between each segmented backup shoe 66, 68, the retaining band 70 closest to the packer is broken while the retaining band 70 away from the packer is unbroken, and the segments of the segmented backup shoe 66, 68 experienced equal spread. When about 2500 pounds force was applied to the packer, the packer experienced 1¼ inch of compressive travel, the tears in the expandable band 140 at the joint between each segmented backup shoe 66, 68 lengthened slightly and remained equal, the retaining band 70 away from the packer appears to be broken, and the segments of the segmented backup shoe 66, 68 still experienced equal spread. When about 4000 pounds force was applied to the packer, the packer experienced 1½ inch compressive travel, tears in the expandable band 140 remain unchanged, and the segments of the segmented backup shoe 66, 68 still experienced equal spread.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What we claim as our invention is:

1. An apparatus for use in a wellbore, comprising:

a mandrel;

a sealing element carried on the mandrel, the sealing element being radially expandable from a first run-in diameter to a second set diameter in response to application of axial force on the sealing element; and an extrusion limiting assembly carried on the mandrel and proximate the sealing element that comprises a plurality of separate segments and a first circumferential band that retains the plurality of segments in a ring shape and substantially covers an outer circumferential surface of the plurality of segments while in a run-in condition of the apparatus, wherein the outer circumferential surface of the plurality of segments in a run-in condition of the apparatus define a circumferential groove and the extrusion limiting assembly further comprises a second circumferential band that is disposed in the groove inside of the first band, wherein the second band breaks during expansion of the segments in response to the application of axial force.

2. The apparatus of claim 1, wherein the first band is expandable and expands with deployment of the plurality of segments while in a set condition of the sealing element.

3. The apparatus of claim 2, wherein the first band comprises an elastomer.

4. The apparatus of claim 3, wherein the first band comprises one of silicone, Nitrile, hydrogenated nitrile butadiene rubber (HNBR), fluoroelastomer, silicon rubber and nitrile rubber.

5. The apparatus of claim 1, wherein the first band breaks with deployment of the plurality of segments during activation of the sealing element.

6. The apparatus of claim 1, wherein the segments are non-metallic.

7. The apparatus of claim 1, wherein the first circumferential band is from about 0.010 inches thick to about 0.090 inches thick.

8. The apparatus of claim 1, wherein the segments are comprised of at least one of phenolic material and epoxy material.

9. The apparatus of claim 1, wherein the segments number inclusively from four segments to sixteen segments.

10. The apparatus of claim 1, further comprising an end component carried on the mandrel at a downhole end of the tool, wherein the end component is comprised of a drillable material and defines a first notch in a downhole edge of the end component, wherein the width of the first notch is at least ten percent and less than forty percent of the circumference of the downhole edge and the depth of the first notch is at least ten percent of the length of the end component.

11. A downhole tool, comprising:

a mandrel;

a packing element carried on the mandrel; and an end component carried on the mandrel at a downhole end of the tool, wherein the end component is comprised of a drillable material and defines a first notch in a downhole edge of the end component, wherein the width of the first notch is at least ten percent and less than forty percent of the circumference of the downhole edge and the depth of the first notch is at least ten percent of the length of the end component, wherein the end component defines a cylindrical shell and the mandrel extends partially into an uphole end of the end component, and the end component further comprises a pin held by two holes in a wall of a downhole end of the end component without passing through the mandrel.

12. The downhole tool of claim 11, wherein the end component further defines a second notch in the downhole edge of the end component, wherein a center of the second notch is about 180 degrees circumferentially away from a center of the first notch.

13. The downhole tool of claim 11, wherein an uphole end of the cylindrical shell has a first outside diameter, and a downhole end of the cylindrical shell has a second outside diameter, wherein the first outside diameter is greater than the second outside diameter.

14. The downhole tool of claim 13, wherein the uphole end of the cylindrical shell has a first inside diameter and the downhole end of the cylindrical shell has a second inside diameter, wherein the first inside diameter is less than the second inside diameter.

15. The downhole tool of claim 11, wherein the downhole edge is beveled.

16. The downhole tool of claim 11, wherein the end component further comprises a ceramic insert coupled to an inside of a downhole end of the end component.

17. The downhole tool of claim 11, further comprising an extrusion limiting assembly carried on the mandrel and proximate the packing element, wherein the extrusion limiting assembly comprises a plurality of separate segments and an elastomeric band that substantially covers an outer circumferential surface of the separate segments.

18. A downhole tool, comprising:

a mandrel;

a packing element carried on the mandrel; and an end component carried on the mandrel at a downhole end of the tool, wherein the end component is comprised of a drillable material and defines a first notch in a downhole edge of the end component, wherein the width of the first notch is at least ten percent and less than forty percent of the circumference of the downhole edge and the depth of the first notch is at least ten percent of the length of the end component, wherein the end component defines a cylindrical shell, an uphole end of the cylindrical shell has a first outside diameter, and a downhole end of the cylindrical shell has a second outside diameter, wherein the first outside diameter is greater than the second outside diameter and wherein the uphole end of the cylindrical shell has a first inside diameter and the downhole end of the cylindrical shell has a second inside diameter, wherein the first inside diameter is less than the second inside diameter.

19. A downhole tool, comprising:

a mandrel;

a packing element carried on the mandrel; and an end component carried on the mandrel at a downhole end of the tool, wherein the end component is comprised of a drillable material and defines a first notch in a downhole edge of the end component, wherein the width of the first notch is at least ten percent and less than forty percent of the circumference of the downhole edge and the depth of the first notch is at least ten percent of the length of the end component, wherein the end component further comprises a ceramic insert coupled to an inside of a downhole end of the end component.

* * * * *